US005306357A

United States Patent [19]

Culling

[11] Patent Number: 5,306,357

[45] Date of Patent: Apr. 26, 1994

[54] SULFURIC ACID RESISTANT ALLOYS

[75] Inventor: John H. Culling, St. Louis, Mo.

[73] Assignee: Carondelet Foundry Company, Pevely, Mo.

[21] Appl. No.: 13,741

[22] Filed: Feb. 4, 1993

[51] Int. Cl.[5] ..... C22C 38/44; C22C 38/16

[52] U.S. Cl. ..... 148/327; 420/45

[58] Field of Search ..... 420/45, 47; 148/327

[56] References Cited

U.S. PATENT DOCUMENTS

| | | | |
|---|---|---|---|
| 2,185,987 | 1/1940 | Parsons, Jr. | 75/125 |
| 3,168,397 | 2/1965 | Scharfstein | 75/128 |
| 4,201,575 | 5/1980 | Henthorne | 75/122 |
| 4,487,744 | 12/1984 | DeBold et al. | 420/584 |

FOREIGN PATENT DOCUMENTS

| | | | |
|---|---|---|---|
| 60-155652 | 8/1985 | Japan | 420/45 |

*Primary Examiner*—Deborah Yee

*Attorney, Agent, or Firm*—Senniger, Powers, Leavitt & Roedel

[57] ABSTRACT

Fully austenitic alloys are provided whose essential components are as follow:

| | |
|---|---|
| NICKEL | 17.3–22.5% BY WEIGHT |
| CHROMIUM | 9–14% |
| MOLYBDENUM | 1.2–2.8% |
| COPPER | 2.6–3.8% |
| MANGANESE | 2.6–4.2% |
| COLUMBIUM | 0.2–0.85% |
| IRON | ESSENTIALLY BALANCE |

Nominally these alloys of the invention will also contain carbon, up to a maximum of about 0.08% by weight, and up to about 1.5% silicon in its usual role in ordinary steel-making practice as a deoxidizer or as a portion of scraps and returns. The usual minor impurities may also be present.

10 Claims, No Drawings

SULFURIC ACID RESISTANT ALLOYS

BACKGROUND OF THE INVENTION

For several decades in the field of corrosion resistant metals most inventive effort has been directed toward development of nickel base or low iron content alloys. While relatively little effort has been made to improve austenitic iron base alloys of low special element content, their importance may be judged by the fact that the ordinary 18% Cr—8% Ni family of stainless steels is employed more than all other corrosion resistant alloys combined. However, those steels have very limited utility in handling sulfuric acid solutions.

Because of cost, availability and metallurgical factors, alloys intended to resist sulfuric acid contain several or all of the elements from the group, iron, nickel, chromium, molybdenum, copper, manganese, silicon and columbium. The nominal compositions of commercial alloys intended for sulfuric acid service as well as for many other applications are shown in Table I. The carbon content is approximate.

TABLE I

| Alloy Designation | Ni | Cr | Mo | Cu | Cb | Si | Fe | C |
|---|---|---|---|---|---|---|---|---|
| 20 | 29 | 20 | 2.5 | 3.5 | — | 1. | 47 | .15 |
| 20Cb3 | 34 | 20 | 2.5 | 3.3 | .6 | .6 | 38 | .06 |
| 20Mo4 | 36 | 23 | 4.0 | 1.0 | .25 | .4 | 35 | .02 |
| 20Mo6 | 35 | 24 | 6.0 | 3.0 | — | .2 | 30 | .02 |
| 825 | 42 | 22 | 3.5 | 2.5 | — | .6 | 26 | .03 |
| G-3 | 45 | 22 | 7.0 | 2.0 | .8 | .6 | 22 | .01 |
| 625 | 63 | 22 | 9.0 | - | 4.0 | .6 | 1 | .06 |

While carbon contents above about 0.08% do not reduce the sulfuric acid resistance of these alloys, at very low carbon levels, less than about 0.03%, they have been found to have good resistance to a wide spectrum of other corrosive substances.

Parson, U.S. Pat. No. 2,185,987, discloses the first notable alloy of this group, commonly referred to as Alloy 20.

To avoid intergranular attack in weld zones, columbium was added to Alloy 20. Because Alloy 20 was reported to suffer stress corrosion in certain concentrations of sulfuric acid, Scharfstein, U.S. Pat. No. 3,168,397, developed the higher nickel 20Cb3 alloy, which was claimed to overcome this problem. DeBold, et al., U.S. Pat. No. 4,487,744, discloses the still higher nickel content 20Mo4 alloy, which is claimed to provide improved resistance to many chemical substances including sulfuric acid. Later, Henthorme, et al., U.S. Pat. No. 4,201,575, developed alloy 20Mo6, which was claimed to have good general corrosion resistance as well as resistance to chloride solution pitting and crevice corrosion. Alloys 825 and G-3 have even higher nickel and lower iron contents, while Alloy 625 has virtually eliminated iron. While these high nickel alloys provide remarkable resistance to many other corrosive substances, their resistance to sulfuric acid solutions at ambient temperatures is achieved at very high cost and consumption of the nonferrous elements involved. Also, while all of these alloys are furnished in wrought or cast forms, fabricability and weldability tend to be lower as iron content drops. Other similar high nickel alloys not listed above possess even lower fabricability and weldability. Thus, there has remained a need for leaner, rather than richer, principally Ni but also Cr containing alloys for the handling of sulfuric acid at ambient temperatures which are also very ductile and weldable.

SUMMARY OF THE INVENTION

Among the several objects of the present invention, therefore, may be noted the provision of improved alloys resistant to both oxidizing and reducing sufuric acid solutions; the provision of such alloys which are resistant to sulfuric acid over a wide range of concentrations at or near ambient temperatures; the provision of such alloys which ar resistant to sulfuric acid containing oxidizing substances, such as nitric acid; the provision of such alloys which have low hardnesses and high ductilities so that they may be readily rolled, forged, welded and machined; the provision of such alloys which may be economically formulated with relatively low proportions of strategic metals, especially chromium; the provision of such alloys whose chromium content is so low that they may be readily formulated from ordinary scraps, ferro alloys and returns; the provision of such alloys whose entire required chromium contents may be readily obtained from recycled, recovered or reclaimed ordinary stainless steel shapes of the several 18% Cr—8% Ni grades; the provision of such alloys that do not require any solution or other special heat treatments either before or after welding; and the provision of such alloys that do not under any high temperature cycle or sequence of thermal exposures form sigma phase, which is very damaging to mechanical properties and corrosion resistance.

Briefly, therefore the present invention is directed to air-meltable, castable, workable, fully austenitic alloys resistant to corrosion in sulfuric acid over a wide range of acid strengths at or near ambient temperatures which may sometimes reach 120° to 140° F. Furthermore, the instant alloys exhibit good short term corrosion resistance to a wide range of concentrations of sulfuric acid at temperatures as high as about 175° F. (80° C.).

DESCRIPTION OF THE PREFERRED EMBODIMENT

In accordance with the present invention, fully austenitic alloys are provided whose essential components are as follow:

| | |
|---|---|
| NICKEL | 17.3-22.5% BY WEIGHT |
| CHROMIUM | 9-14% |
| MOLYBDENUM | 1.2-2.8% |
| COPPER | 2.6-3.8% |
| MANGANESE | 2.6-4.2% |
| COLUMBIUM | 0.2-0.85% |
| IRON | ESSENTIALLY BALANCE |

The alloys of the invention are of such low chromium content that their entire needs for that element may be obtained from recycled scraps, trimmings, used metallic parts, borings, turnings and similar materials from the common grades of 18% Cr—8% Ni types, including those of the AISI designations, 302, 303, 304, 304L, 305, 308, 309, 310 or their low-carbon cast equivalents.

Nominally these alloys of the invention will also contain carbon, up to a maximum of about 0.08% by weight, and up to about 1.5% silicon in its usual role in ordinary steel-making practice as a deoxidizer or as a portion of scraps and returns. The usual minor impurities may also be present.

Because the alloys of the invention contain relatively large amounts of manganese and some chromium, it has been generally found unnecessary to intentionally add silicon to the melt. However, residual amounts of this element as low as about 0.1%, have been found to be present when heats are prepared from relatively pure materials. On the other hand, from about 0.8% Si up to about 1.2% Si has been intentionally added in some experimental heats made up largely from scraps and returns. The corrosion resistance and state of deoxidation of the resulting alloys have been apparently unaffected over the entire range of such additions of silicon, but silicon should preferably be limited to a maximum of about 1.5% for reasons of structural stability and weldability.

In all alloys carbon is detrimental to corrosion resistance in most aggressive substances. Accordingly, while the alloys of the invention may contain up to 0.08% C, it is preferable that there be sufficient columbium (niobium) present so that the columbium content is at least about eight times the carbon content.

While the alloys of the invention contain no more than about 14% Cr, at least about 9% Cr was found to be necessary to achieve sufficient corrosion resistance.

Molybdenum and copper are both well known for their beneficial effects upon resistance to sulfuric acid. While both elements begin their beneficial effects at relatively small fractions of a percent content, the minimum values for alloys of the invention were determined by formulations and testing of many different alloy compositions. Thus, it was found that copper content must not exceed solubility limits and greater than about 3.8% provides no additional benefit but still allows a practical production control range compared to the 2.6% Cu minimum. While molybdenum increases resistance to reducing substances it tends to decrease resistance to oxidizers. It also appears that increasing molybdenum content requires a concurrent increase in nickel content for good resistance to sulfuric acid. Test results set forth below demonstrate the detrimental effects of high molybdenum contents in the instant lean alloys even when nickel and/or chromium contents are higher than the maximums for the content ranges set forth above.

As a feature of the alloys of the invention it has been found that for good resistance to sulfuric acid corrosion and stress corrosion cracking the nickel content always exceeds the chromium content and that a minimum of about 17.3% nickel is required. A nickel content greater than about 22.5% in alloys of the invention not only increases cost but also lowers sulfuric acid resistance to some extent.

The usual impurities that may be found in air melted austenitic alloys formulated from ordinary raw materials and returns include cobalt, phosphorus, sulfur, aluminum, titanium and nitrogen. Less than 0.5% Co, 0.1% each of nitrogen, aluminum and titanium, and smaller amounts of phosphorus and sulfur do not present problems for alloys of the invention.

The following examples illustrate the invention.

EXAMPLE 1

One hundred pounds heats of several different alloys of the invention were prepared in accordance with the invention by air melting in a high frequency induction furnace and casting into tensile test bar blocks as well as corrosion test bars. The compositions of these alloys are set forth in Table II, with the balance in each instance being essentially iron. These alloys are designated alphabetically.

Several comparative alloys were prepared in a similar manner. The composition of the comparative alloys are also set forth in Table II, but are all designated numerically.

TABLE II

| ALLOY DESIGNATION | PERCENT BY WEIGHT OF ALLOYING ELEMENTS | | | | | | | | |
|---|---|---|---|---|---|---|---|---|---|
| | Ni | Cr | Mo | Cu | Mn | Cb | C | Si | N |
| A | 18.14 | 13.43 | 1.20 | 3.17 | 3.29 | .62 | .03 | .55 | .0 |
| B | 18.69 | 13.96 | 1.34 | 3.09 | 3.54 | .54 | .02 | .32 | NT |
| C | 17.33 | 9.01 | 2.06 | 3.27 | 2.86 | .65 | .04 | .11 | .01 |
| D | 21.20 | 11.82 | 1.47 | 3.35 | 3.45 | .58 | .05 | .18 | NT |
| E | 18.09 | 13.94 | 1.55 | 2.97 | 2.68 | .39 | .03 | .78 | .03 |
| F | 19.51 | 13.93 | 1.17 | 2.93 | 3.43 | .51 | .04 | .23 | .04 |
| G | 22.24 | 13.62 | 1.24 | 3.37 | 4.20 | .83 | .06 | .20 | .06 |
| H | 18.78 | 12.68 | 2.76 | 3.74 | 3.56 | .63 | .04 | .56 | NT |
| I | 21.69 | 13.90 | 2.04 | 3.33 | 3.34 | .21 | .01 | .21 | .07 |
| J | 19.27 | 13.40 | 2.02 | 3.21 | 3.53 | .57 | .04 | .48 | .08 |
| 1273 | 17.85 | 9.95 | .86 | 2.90 | 3.26 | .26 | .02 | .52 | NT |
| 1274 | 15.10 | 11.66 | .87 | 2.87 | 3.80 | .46 | .04 | .28 | NT |
| 1275 | 15.49 | 11.89 | .72 | 2.77 | 3.44 | .38 | .03 | .34 | NT |
| 1320 | 11.62 | 8.94 | .65 | 2.82 | 3.44 | .27 | .02 | .55 | .15 |
| 1322 | 12.76 | 12.72 | 2.14 | 3.45 | 3.72 | .75 | .06 | .18 | .18 |
| 1323 | 13.30 | 9.68 | 2.15 | 4.48 | 3.55 | .78 | .04 | .23 | .17 |
| 1326 | 15.04 | 12.22 | 2.04 | 3.20 | 4.07 | .35 | .02 | .38 | NT |
| 1327 | 10.92 | 14.84 | 1.93 | 3.25 | 3.76 | .27 | .01 | .44 | NT |
| 1333 | 13.01 | 13.05 | 4.88 | 2.89 | 10.03 | — | .04 | .55 | .13 |
| 1334 | 17.69 | 11.49 | 6.40 | 3.30 | 9.35 | .45 | .03 | .35 | .15 |
| 1335 | 15.52 | 14.25 | 7.03 | 3.23 | 9.25 | .58 | .04 | .12 | NT |
| 1338 | 24.41 | 18.32 | .01 | 3.13 | 3.73 | .12 | .02 | .35 | NT |
| 1359 | 24.43 | 18.28 | .15 | 3.44 | 3.89 | .16 | .02 | .44 | NT |
| 1396 | 19.72 | 18.08 | 6.78 | 1.10 | 3.88 | — | .01 | .56 | .15 |
| 1256 | 18.85 | 17.62 | 5.98 | 4.07 | 3.36 | .66 | .05 | .26 | .02 |
| 1229 | 20.21 | 10.03 | 5.01 | 1.11 | .56 | — | .02 | .42 | NT |

NT = Not Tested

Using the as cast physical test blocks, the mechanical properties of each of the alloys of Table II was measured. The results of these measurements are set forth in Table III.

TABLE III

MECHANICAL PROPERTIES OF ALLOYS AS CAST

| ALLOY DESIGNATION | TENSILE STRENGTH P.S.I. | YIELD STRENGTH P.S.I. | TENSILE ELONGATION % | BRINELL HARDNESS NUMBER |
|---|---|---|---|---|
| A | 72,000 | 29,700 | 37 | 141 |
| B | 73,400 | 32,300 | 43 | 121 |
| C | 55,600 | 20,700 | 50 | 118 |
| D | 59,600 | 21,800 | 50 | 120 |
| E | 64,300 | 24,700 | 44 | 126 |
| F | 61,400 | 23,600 | 40 | 116 |
| G | 65,900 | 23,500 | 48 | 125 |
| H | 64,000 | 24,900 | 43 | 126 |
| I | 62,800 | 30,200 | 68 | 107 |
| J | 64,200 | 24,800 | 66 | 115 |
| 1273 | 57,400 | 21,800 | 48.5 | 121 |
| 1274 | 61,500 | 25,600 | 48 | 111 |
| 1275 | 62,700 | 27,600 | 42 | 131 |
| 1320 | 75,800 | 32,800 | 39 | 137 |
| 1322 | 79,300 | 33,800 | 34.5 | 139 |
| 1323 | 78,900 | 33,700 | 32 | 125 |
| 1326 | 61,600 | 23,300 | 57 | 116 |
| 1327 | 64,500 | 25,700 | 51.1 | 121 |
| 1333 | 71,200 | 29,700 | 50 | 118 |
| 1334 | 75,200 | 38,400 | 30.7 | 126 |
| 1335 | 68,900 | 48,500 | 15.7 | 177 |
| 1358 | 62,900 | 25,700 | 56 | 116 |
| 1359 | 62,800 | 30,200 | 53 | 107 |
| 1396 | 73,900 | 43,200 | 19 | 187 |
| 1256 | 66,200 | 31,000 | 18.5 | 103 |
| 1229 | 76,200 | 29,000 | 31 | 133 |

EXAMPLE 2

The corrosion sample test bars from each heat were machined into 1½ inch diameter by ¼ inch thick discs, each disc having a ⅛ diameter hole in the center. Each of the discs was polished to a 600 grit finish, cleaned by carbon tetrachloride to remove residual machining oil and grit, then cleaned in detergent and hot water and dried.

Each clean, dry disc employed in any of the corrosion tests below was weighed to the nearest 10,000th of a gram and suspended in one of the test solutions by a platinum wire for an appropriate exposure period.

After exposure, test samples were then cleaned with a nylon brush and tap water, dried, and again weighed to the nearest 10,000th of a gram. The corrosion rate of each disc, in mils per year (MPY), was calculated by the following formula.

$$RMPY = 393.7 \frac{Wo - Wf}{ATD}$$

where

RMPY=corrosion rate in MPY

Wo=original weight of sample

Wf=final weight of sample

A=area of sample in square centimeter

T=duration of test in years

D=density of alloy in grams per cc.

All of the alloys of the invention were tested by exposure of samples of each in each of the following test solutions at a room temperature of about 72° F. (22° C.) for a period of two days:

(A) sulfuric acid-water concentrations of 10%, 25%, 30%, 40%, 50%, 60% and 70% sulfuric acid by weight (B) nitric acid-water solutions of 10%, 30% and 65% concentration by weight (C) sulfuric acid-nitric acid-water mixed acid solutions to include each possible acid combination of 10%, 25% or 40% sulfuric, with 5%, 10% or 20% nitric by weight.

None of the tests on each of the alloys of the invention resulted in a corrosion rate exceeding 3 MPY. In a majority of the tests the corrosion rate was well less than 1 MPY or undetectable. In most applications a corrosion rate of about 10 MPY represents good performance, while a rate of about 5 MPY is ordinarily deemed excellent service or an unimportant rate of attack.

EXAMPLE 3

In the same manner as in Example 2 above, corrosion tests were run for eight hours on samples of all alloys of the invention and of samples of all comparative alloys in 10%, 25%, 40%, 50%, 60%, 70%, 93% and 96% by weight sulfuric acid solutions at 176° F. (80° C.). Results of these corrosion tests are set forth in Table IV. Published values for the industry standard 20Cb3 alloy are also included in Table IV.

TABLE IV

CORROSION RATES IN MPY PENETRATION AT 80° C. IN VARIOUS SULFURIC ACID-WATER SOLUTIONS, BY WEIGHT

| ALLOY DESIGNATION | 10% | 25% | 40% | 50% | 60% | 70% | 93% | 96% |
|---|---|---|---|---|---|---|---|---|
| A | NIL | 15.7 | 14.6 | 10.3 | 6.2 | 5.9 | 20.0 | 11.9 |
| B | 5.6 | 0.8 | 1.6 | 3.8 | 3.5 | NIL | 21.6 | 12.2 |
| C | 22.9 | 10.8 | 9.8 | 7.3 | 7.0 | 3.2 | 110.7 | 53.1 |
| D | 22.1 | 13.7 | 7.6 | 8.6 | 4.9 | 2.2 | 32.6 | 15.7 |
| E | 16.7 | 10.7 | 3.5 | 5.5 | 3.0 | 5.9 | 18.4 | 15.4 |

TABLE IV-continued

CORROSION RATES IN MPY PENETRATION AT 80° C. IN VARIOUS SULFURIC ACID-WATER SOLUTIONS, BY WEIGHT

| ALLOY DESIGNATION | 10% | 25% | 40% | 50% | 60% | 70% | 93% | 96% |
|---|---|---|---|---|---|---|---|---|
| F | 25.7 | 15.6 | 9.6 | 8.8 | 4.3 | 8.4 | 19.2 | 12.7 |
| G | 17.9 | 10.7 | 7.6 | 8.4 | 6.5 | 5.8 | 35.0 | 9.7 |
| H | 24.0 | 14.1 | 18.2 | 21.6 | 10.6 | 4.7 | 62.5 | 9.6 |
| I | 20.9 | 13.6 | 15.2 | 7.6 | 10.3 | 11.2 | 32.0 | 14.2 |
| J | 21.8 | 10.4 | 9.2 | 8.9 | 4.6 | 8.7 | 19.9 | 12.3 |
| 1273 | 42.8 | 19.2 | 23.5 | 46.0 | 115.6 | 84.0 | 175.0 | 106.4 |
| 1274 | 48.1 | 44.2 | 126.1 | 348.8 | 497.3 | 194.4 | 320.8 | 186.3 |
| 1275 | 26.9 | 37.4 | 44.1 | 185.5 | 306.7 | 158.0 | 261.1 | 125.3 |
| 1320 | 341.1 | 532.0 | 1410.0 | 2002. | 807.2 | 508.6 | 676.2 | 289.3 |
| 1322 | 126.5 | 101.3 | 68.2 | 92.8 | 191.8 | 87.6 | 256.1 | 157.3 |
| 1323 | 61.8 | 40.2 | 27.8 | 38.3 | 30.7 | 18.8 | 214.9 | 117.5 |
| 1326 | 44.5 | 67.2 | 82.9 | 44.9 | 105.8 | 33.1 | 199.3 | 113.4 |
| 1327 | 237.5 | 579.6 | 78.5 | 96.3 | 98.7 | 1837. | 648.3 | 172.6 |
| 1333 | 129.6 | 187.3 | 93.4 | 35.3 | 17.7 | 26.5 | 53.5 | 31.0 |
| 1334 | 50.9 | 55.8 | 11.8 | 12.0 | 9.6 | 7.9 | 43.5 | 58.9 |
| 1335 | 70.3 | 110.6 | 29.2 | 13.8 | 3.5 | 6.5 | 39.1 | 47.2 |
| 1358 | 776.1 | 1281. | 3376. | 6002. | 8776. | NT | NT | NT |
| 1359 | 10.6 | 103.2 | 83.8 | 87.6 | 1811. | 2180. | 18.8 | 18.3 |
| 1396 | 13.3 | 69.1 | 67.2 | 25.8 | 16.9 | 26.5 | 62.2 | 12.3 |
| 1256 | 2.7 | 63.5 | 42.0 | 18.2 | 11.1 | 7.7 | 7.2 | 13.1 |
| 1229 | 51.8 | 55.5 | 11.8 | 12.2 | 9.5 | 11.2 | 43.5 | 51.5 |
| 20Cb3 | 6. | 11. | 9. | 7. | 11. | 50. | 20. | 13. |

All test results with rates over 1000 MPY were rounded to drop the decimal value.

While the alloys of the invention were not intended for use with concentrated sulfuric acid, it is obvious from these test results that those alloys of greater than about 12% chromium content display acceptable corrosion rates in 96% sulfuric acid or higher concentrations even at 176° F. (80° C.). Also, while the alloys of the invention are intended for ambient temperature service to 120° F. to 140° F. (48° to 60° C.), these test results show that they would not undergo catastrophic failure in any sulfuric acid concentration up to 70% even if temperatures should accidentally reach as high as 176° F. (80° C.) for short periods of time.

EXAMPLE 4

In the same manner as Example 2 above, corrosion tests were run on samples from alloys of the invention at 150° F. (66° C.) for a period of 8 hours in 10%, 25%, 40%, 50%, 60%, 70% and 96% sulfuric acid solutions. No sample from any alloy of the invention in any of these test solutions displayed a corrosion rate above 10 MPY.

EXAMPLE 5

Although short term tests conducted in boiling sulfuric acid solutions at concentrations of 10% to 40% typically result in rates of attack for most alloys above about 25 MPY, which is probably the highest practical limit in most situations, nevertheless, such tests have been historically conducted because they have been considered by many workers in the field to represent a good comparative indicator of an alloy's ability to resist sulfuric acid in particular, or even, reducing solutions in general. Therefore, in the same manner as Example 2 above, corrosion tests were conducted for a period of eight hours on samples of alloys of the invention and on samples of comparative alloys in boiling sulfuric acid solutions of 10%, 25%, 30%, and 40% concentrations. Results of these tests are set forth in Table V.

TABLE V

CORROSION RATES IN MPY PENETRATION IN VARIOUS BOILING SULFURIC ACID-WATER SOLUTIONS

| ALLOY DESIGNATION | 10% | 25% | 30% | 40% |
|---|---|---|---|---|
| A | 57.7 | 37.2 | 38.2 | 81.2 |
| B | 44.6 | 38.2 | 30.7 | 35.4 |
| C | 60.1 | 29.5 | 28.2 | 32.9 |
| D | 41.2 | 25.1 | 24.8 | 27.0 |
| E | 50.8 | 28.7 | 27.7 | 35.7 |
| F | 30.1 | 58.0 | 50.0 | 48.2 |
| G | 41.6 | 48.3 | 34.2 | 30.2 |
| H | 55.3 | 40.3 | 44.1 | 80.6 |
| I | 40.8 | 35.6 | 34.7 | 50.1 |
| J | 48.2 | 38.6 | 32.6 | 36.3 |
| 1273 | 189.1 | 93.6 | NT | 63.5 |
| 1274 | 558.1 | 182.5 | NT | 232.1 |
| 1275 | 392.4 | 115.3 | NT | 119.6 |
| 1322 | 495.1 | 189.3 | NT | 152.6 |
| 1323 | 276.8 | 114.8 | NT | 158.8 |
| 1326 | 367.5 | 131.8 | NT | 108.0 |
| 1327 | 6,803. | 659.3 | NT | 176.8 |
| 1333 | 98.8 | 165.5 | NT | 82.6 |
| 1334 | 98.9 | 81.8 | NT | 78.2 |
| 1335 | 158.0 | 157.7 | NT | 124.5 |
| 1359 | 270.1 | 274.9 | NT | 1,114. |
| 1296 | 155.0 | 231.1 | NT | 245.1 |
| 1256 | 79.2 | 129.3 | NT | 111.1 |

NT = Not Tested

All test results with rates over 1000 MPY were rounded to drop the decimal value.

Alloy 20Cb3 is one of the most widely applied sulfuric acid resistant alloys and has been a standard of comparison for many years. Alloy 20Mo4 is the more recent improved variation. The ranges of corrosion rates of these alloys in the boiling acid solutions as compared to those for alloys of the invention is as follows:

TABLE VI

| | ALLOYS OF THE INVENTION | 20Cb3 | 20Mo4 |
|---|---|---|---|
| 10% | 30-60 | 20-36 | 25-41 |
| 25% | 25-58 | 35-50 | 32-55 |
| 30% | 25-50 | 38-52 | 35-58 |
| 40% | 27-85 | 45-60 | 42-60 |
| TYPICAL | 58 | 38 | 35 |

TABLE VI-continued

| ALLOYS OF THE INVENTION | 20Cb3 | 20Mo4 |
|---|---|---|
| IRON CONTENT | | |

Considering the typical iron contents for the alloys of the invention as compared to those of the much richer, more costly alloys, 20Cb3 and 20Mo4, the boiling acid corrosion rates of the former are remarkably close to those of the other alloys.

EXAMPLE 6

Although sulfuric acid solutions of up to 40% concentration by weight are reducing, it is possible for them to contain oxidizing ions as contaminants or by intention. As nitric acid is a very strong oxidizer, corrosion tests were conducted in the same manner as Example 2 above on samples of alloys of the invention in solutions of various strengths of sulfuric acid plu 5% nitric acid. These tests were run for a period of eight hours. Results of these tests are set forth in Table VII.

TABLE VII

CORROSION RATES IN MPY PENETRATION IN SULFURIC ACID SOLUTIONS CONTAINING 5% NITRIC ACID 80° C. TESTS

| ALLOY DESIGNATION | 10% | 25% | 40% | BOILING TESTS 10% |
|---|---|---|---|---|
| A | 43.9 | NIL | 12.7 | 5.0 |
| B | 6.5 | 3.4 | 1.4 | 8.7 |
| C | 69.1 | 18.9 | 140.7 | 3089.9 |
| D | 6.2 | NIL | 9.2 | 15.7 |
| E | 7.7 | NIL | 0.8 | 11.3 |
| F | 7.4 | NIL | 0.5 | 7.4 |
| G | 7.9 | NIL | 2.2 | 13.2 |
| H | 6.3 | NIL | 7.6 | 14.6 |
| I | 7.7 | NIL | 1.8 | 12.6 |
| J | 7.5 | NIL | 2.0 | 13.7 |

Alloy C, which contains only 9% chromium, was rapidly attacked, but other alloys of the invention, of about 12% to 14% chromium content, were apparently aided in passivation behavior by the presence of the nitric acid and would apparently be suitable for service at least to 80° C. in sulfuric acid concentrations up to 40% and in up to about 10% sulfuric acid to the boiling point for at least certain mixed acid solutions. Nonetheless, alloys of the invention may still contain as low as 9% chromium for service up to at least about 150° F. (66° C.) in sulfuric acid concentrations up to about 70% by weight.

The foregoing description of the several embodiments of the invention is not intended as limiting of the invention. As will be apparent to those skilled in the art, variations and modifications of the invention may be made without departure from the spirit and scope of this invention.

What is claimed is:

1. An austenitic alloy consisting essentially of about:

| | |
|---|---|
| NICKEL | 17.3–22.5% BY WEIGHT |
| CHROMIUM | 9–14% |
| MOLYBDENUM | 1.2–2.8% |
| COPPER | 2.6–3.8% |
| MANGANESE | 2.6–4.2% |
| COLUMBIUM | 0.2–0.85% |
| IRON | ESSENTIALLY BALANCE |

2. An alloy of claim 1 further containing up to a maximum of about 0.08% carbon and up to about 1.5% silicon, both by weight.

3. An alloy of claim 1 further containing a maximum of about 0.08% carbon by weight wherein the percent by weight of columbium is at least about eight times the weight percent of carbon.

4. An alloy of claim 2 wherein the chromium content is at least about 12% by weight.

5. An alloy of claim 3 wherein the chromium content is at least about 12% by weight.

6. An alloy of claim 2 consisting essentially of about:

| | |
|---|---|
| NICKEL | 18–19% BY WEIGHT |
| CHROMIUM | 13–14% |
| MOLYBDENUM | 1.2–1.6% |
| COPPER | about 3% |
| MANGANESE | 2.5–3.5% |
| COLUMBIUM | 0.4–0.6% |
| CARBON | max of about 0.03% |
| SILICON | 0.3–0.8% |
| NITROGEN | UP TO 0.3% |
| IRON | ESSENTIALLY BALANCE |

7. An alloy of claim 2 consisting essentially of about:

| | |
|---|---|
| NICKEL | 19–22.5% BY WEIGHT |
| CHROMIUM | 12.5–14% |
| MOLYBDENUM | 1.2–2.8% |
| COPPER | 3–3.8% |
| MANGANESE | 3.4–4.2% |
| COLUMBIUM | 0.2–0.85% |
| CARBON | 0.1–0.6% |
| SILICON | 0.2–0.6% |
| NITROGEN | UP TO 0.08% |
| IRON | ESSENTIALLY BALANCE |

8. An alloy of claim 3 consisting essentially of about:

| | |
|---|---|
| NICKEL | 18.14% BY WEIGHT |
| CHROMIUM | 13.43% |
| MOLYBDENUM | 1.20% |
| COPPER | 3.17% |
| MANGANESE | 3.29% |
| COLUMBIUM | .62% |
| CARBON | .03% |
| SILICON | .55% |
| NITROGEN | UP TO 0.08% |

9. An alloy of claim 3 consisting essentially of about:

| | |
|---|---|
| NICKEL | 18.69% BY WEIGHT |
| CHROMIUM | 13.96% |
| MOLYBDENUM | 1.34% |
| COPPER | 3.09% |
| MANGANESE | 3.54% |
| COLUMBIUM | .54% |
| CARBON | .02% |
| SILICON | .32% |
| NITROGEN | UP TO 0.08% |

10. An alloy of claim 3 consisting essentially of about:

| | |
|---|---|
| NICKEL | 18.09% BY WEIGHT |
| CHROMIUM | 13.94% |
| MOLYBDENUM | 1.55% |
| COPPER | 2.97% |
| MANGANESE | 2.68% |
| COLUMBIUM | .39% |
| CARBON | .03% |
| SILICON | .78% |
| NITROGEN | .03% |

* * * * *